US010374313B2

(12) United States Patent
Kwon et al.

(10) Patent No.: US 10,374,313 B2
(45) Date of Patent: Aug. 6, 2019

(54) MULTILAYER ELECTRONIC COMPONENT AND MULTILAYER CHIP ANTENNA INCLUDING THE SAME

(71) Applicant: SAMSUNG ELECTRO-MECHANICS CO., LTD., Suwon-si, Gyeonggi-do (KR)

(72) Inventors: Soon Kwang Kwon, Suwon-si (KR); Chang Ryul Jung, Suwon-si (KR); Jung Wook Seo, Suwon-si (KR); In Gyu Kim, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/289,581

(22) Filed: Oct. 10, 2016

(65) Prior Publication Data

US 2017/0186527 A1 Jun. 29, 2017

(30) Foreign Application Priority Data

Dec. 29, 2015 (KR) ..... 10-2015-0188322

(51) Int. Cl.
*H01Q 7/06* (2006.01)
*H01F 27/255* (2006.01)
(Continued)

(52) U.S. Cl.
CPC ..... *H01Q 7/06* (2013.01); *H01F 17/00* (2013.01); *H01F 17/0013* (2013.01);
(Continued)

(58) Field of Classification Search
CPC ..... H01Q 7/06; H01Q 1/2283; H01F 17/00; H01F 17/04; H01F 27/266
See application file for complete search history.

(56) References Cited

U.S. PATENT DOCUMENTS 6,229,444 B1 5/2001 Endo et al.
6,238,779 B1 * 5/2001 Iwao ..... B32B 18/00 174/261
(Continued)

FOREIGN PATENT DOCUMENTS

CN 1363938 A 8/2002
CN 1393892 A 1/2003
(Continued)

OTHER PUBLICATIONS

Korean Office Action dated May 18, 2017 in Korean Patent Application No. 10-2015-0188322, 14 pages.
(Continued)

*Primary Examiner* — Hoang V Nguyen
(74) *Attorney, Agent, or Firm* — McDermott Will & Emery LLP

(57) ABSTRACT

A multilayer electronic component includes a body and a coil. The body includes a plurality of sheets each containing magnetic powder particles. The coil includes an uppermost coil pattern disposed on a top surface of an uppermost sheet among the plurality of sheets, a lowermost coil pattern disposed on a bottom surface of a lowermost sheet among the plurality of sheets, and side coil patterns disposed on edges of central sheets disposed between the uppermost sheet and the lowermost sheet in a central portion of the body. The magnetic powder particles have shape anisotropy, and a major axes of the magnetic powder particles are aligned with each other within the body. A multilayer chip antenna can include the multilayer electronic component.

20 Claims, 15 Drawing Sheets

(51) Int. Cl.

| | |
|---|---|
| ***H01F 17/04*** | (2006.01) |
| ***H01F 17/00*** | (2006.01) |
| ***H01F 27/26*** | (2006.01) |
| ***H01Q 1/22*** | (2006.01) |

(52) U.S. Cl.
CPC ..... *H01F 17/0033* (2013.01); *H01F 17/04* (2013.01); *H01F 27/255* (2013.01); *H01F 27/266* (2013.01); *H01Q 1/2283* (2013.01)

(56) References Cited

U.S. PATENT DOCUMENTS

| | | | | |
|---|---|---|---|---|
| 6,483,413 | B1 * | 11/2002 | Maeda | H01F 5/003 336/200 |
| 2003/0001711 | A1 | 1/2003 | Tanaka et al. | |
| 2007/0158438 | A1 | 7/2007 | Fukuda et al. | |
| 2009/0051474 | A1 | 2/2009 | Lee et al. | |
| 2010/0039200 | A1 * | 2/2010 | Yan | H01F 3/10 336/147 |
| 2010/0308949 | A1 | 12/2010 | Lim et al. | |
| 2014/0203985 | A1 | 7/2014 | Tsubaki et al. | |
| 2014/0374644 | A1 * | 12/2014 | Eguchi | H01F 1/28 252/62.54 |
| 2015/0102888 | A1 | 4/2015 | Kim et al. | |
| 2015/0235753 | A1 * | 8/2015 | Chatani | H01F 27/245 336/200 |

FOREIGN PATENT DOCUMENTS

| | | | |
|---|---|---|---|
| CN | 101896983 | A | 11/2010 |
| CN | 104575942 | A | 4/2015 |
| JP | H05175060 | A | 7/1993 |
| JP | 10-256021 | | 8/1998 |
| JP | H10208942 | A | 8/1998 |
| JP | H10-241943 | A | 9/1998 |
| JP | 11-353561 | A | 12/1999 |
| JP | 3458805 | B2 | 8/2003 |
| JP | 2005-184916 | A | 7/2005 |
| JP | 2007166379 | A | 6/2007 |
| JP | 2011171612 | A | 9/2011 |
| JP | 2013-125610 | A | 6/2013 |
| JP | 2013-172241 | A | 9/2013 |
| KR | 2002-0050132 | | 6/2002 |
| KR | 10-2009-0019251 | A | 2/2009 |
| KR | 2010-0008600 | A | 1/2010 |
| KR | 10-2010-0074450 | A | 7/2010 |
| KR | 10-0982639 | B1 | 9/2010 |
| WO | 2012124561 | A1 | 9/2012 |
| WO | 2013161608 | A1 | 10/2013 |

OTHER PUBLICATIONS

First Office Action issued in Chinese Patent Application No. 201611019749.6, dated Jul. 9, 2018 (English translation).
Notice of Reasons for Refusal issued in Japanese Patent Application No. 2016-214598, dated Oct. 16, 2018 (with English translation).
Office Action issued in corresponding Japanese Patent Application No. 2016-214598, dated May 14, 2019.

* cited by examiner

MULTILAYER ELECTRONIC COMPONENT AND MULTILAYER CHIP ANTENNA INCLUDING THE SAME

CROSS-REFERENCE TO RELATED APPLICATION

This application claims the priority and benefit of Korean Patent Application No. 10-2015-0188322 filed on Dec. 29, 2015, with the Korean Intellectual Property Office, the disclosure of which is incorporated herein by reference.

BACKGROUND

The present disclosure relates to a multilayer electronic component and a multilayer chip antenna including the same, and more particularly, to a multilayer inductor, and a multilayer chip antenna including a body as a core part and including a coil as a coil part.

Magnetic materials commonly used in inductors, such as ferrite or metal powder particles, have spherical shapes. Therefore, when a magnetic field is applied to the magnetic materials, the magnetic field is uniformly distributed in all directions and is not concentrated in any particular direction. However, in near field communications (NFC) or magnetic secure transmissions (MST), a component having an increased recognition distance and providing a concentration of the magnetic field in a certain direction is needed.

The related art discloses a multilayer inductor including a body in which a plurality of magnetic layers are stacked, where the magnetic layers have a plurality of conductor patterns printed thereon. However, the multilayer inductor does not provide for alignment of a direction of a magnetic field of the magnetic material in the magnetic layers, or for adjustment of the direction of the conductor patterns.

SUMMARY

An aspect of the present disclosure may provide a multilayer electronic component having increased magnetic flux and inductance provided by concentrating a magnetic field in a certain direction. A multilayer chip antenna including the same is additionally provided.

According to an aspect of the present disclosure, a multilayer electronic component may include a body and a coil. The body includes a plurality of stacked sheets each containing a magnetic powder particle. The coil is disposed on an external surface of the body.

The coil disposed on the external surface of the body may include an uppermost coil pattern disposed on a top surface of an uppermost sheet among the plurality of stacked sheets, a lowermost coil pattern disposed on a bottom surface of a lowermost sheet among the plurality of stacked sheets, and side coil patterns disposed on edges of central sheets disposed between the uppermost sheet and the lowermost sheet.

The magnetic powder particles in the plurality of sheets of the body may have shape anisotropy, and major axes of the magnetic powder particles may be aligned with each other in one direction of the body.

According to another example embodiment, a multilayer chip antenna may include the multilayer electronic component, and a main antenna electrically coupled to the multilayer electronic component.

According to a further example embodiment, an electronic component includes a body and a coil. The body includes magnetic powder particles having shape anisotropy that are disposed such that a major axis of each magnetic powder particle is parallel to major axes of the other magnetic powder particles. The coil includes a plurality of windings disposed on outer surfaces of the body. Each winding of the coil includes central coil patterns disposed on a respective outer surface of the body, and an outer surface of each central coil pattern is flush with or disposed outwardly from the respective outer surface of the body.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
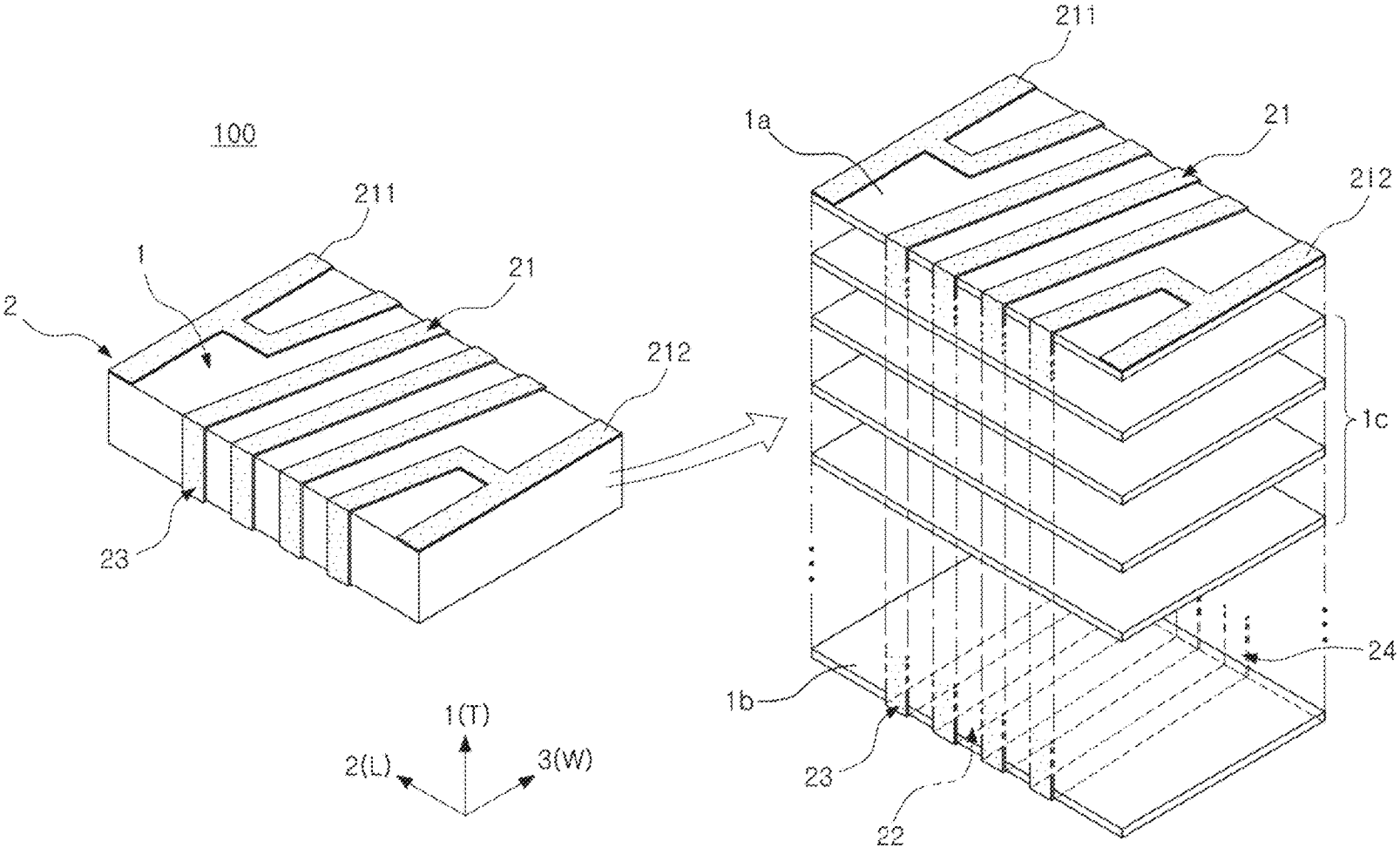
FIG. 1 is a schematic perspective view illustrating a multilayer electronic component according to an example embodiment.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the example embodiments.

Spatially relative terms, such as "above," "upper," "below," "lower," and the like, may be used herein for ease of description to describe one element's positional relationship relative to one or more other element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the devices, elements, or figures. The device may be otherwise oriented (rotated 90 degrees or at other orientations) and the spatially relative descriptors used herein may be interpreted accordingly.

The terminology used herein is for describing particular illustrative embodiments only and is not intended to be limiting of the present disclosure. As used herein, the singular forms "a," "an," and "the" are intended to include the plural forms as well, unless the context clearly indicates otherwise. It will be further understood that the terms "comprises" and/or "comprising" when used in this specification, specify the presence of stated features, integers, steps, operations, members, elements, and/or groups, but do not preclude the presence or addition of one or more other features, integers, steps, operations, members, elements, and/or groups.

Hereinafter, embodiments of the present disclosure will be described with reference to schematic views illustrating embodiments of the present disclosure. In the drawings, components having ideal shapes are shown. However, variations from these shapes, for example due to variability in manufacturing techniques and/or tolerances, also fall within the scope of the disclosure. Thus, embodiments of the present disclosure should not be construed as being limited to the particular shapes of regions shown herein, but should more generally be understood to include changes in shape resulting from manufacturing methods and processes. The following embodiments may also be constituted by one or a combination thereof.

The present disclosure describes a variety of configurations, and only illustrative configurations are shown herein. However, the disclosure is not limited to the particular illustrative configurations presented herein, but extends to other similar/analogous configurations as well.

Hereinafter, a multilayer electronic component and an antenna including the same according to an example embodiment will be described. However, the present disclosure is not necessarily limited thereto.

Multilayer Electronic Component

Figure 2:
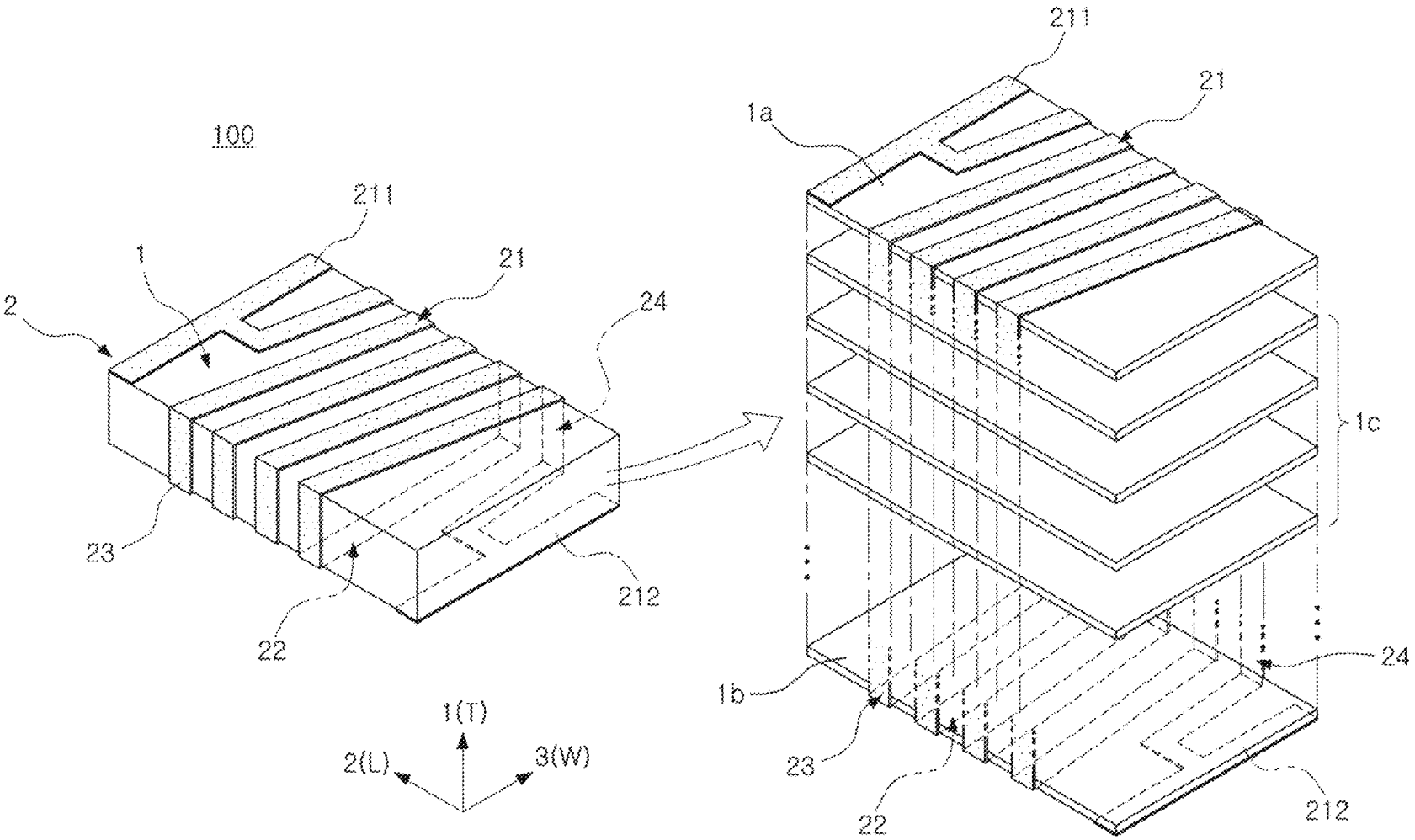
FIG. 2 is a schematic perspective view illustrating a multilayer electronic component according to a modified example of FIG. 1.

FIG. 1 is a schematic perspective view illustrating a multilayer electronic component according to an example embodiment and FIG. 2 is a schematic perspective view illustrating another multilayer electronic component according to a modified example of FIG. 1.

Referring to each of FIGS. 1 and 2, a multilayer electronic component 100 may include a body 1 and a coil 2 disposed on an external surface of the body 1.

Since the multilayer electronic components 100 of FIGS. 1 and 2 includes the same body 1, the body 1 of the multilayer electronic component will first be described.

The body 1 may have a substantially hexahedral shape including a first surface and a second surface opposing each other in a first (thickness T) direction of the body 1, a third surface and a fourth surface opposing each other in a second (length L) direction thereof, and a fifth surface and a sixth surface opposing each other in a third (width W) direction thereof, but the shape of the body 1 is not limited thereto.

The first direction of the body corresponds to a stacking direction in which a plurality of sheets are stacked, and refers to a thickness T direction of the body 1. The second direction of the body refers to a length L direction of the body 1, and the third direction of the body refers to a width W direction of the body 1.

The body 1 may be formed by stacking the uppermost sheet 1*a*, the lowermost sheet 1*b*, and a multilayer sheet 1*c* disposed between the uppermost sheet 1*a* and the lowermost sheet 1*b* and including a plurality of central sheets stacked together in the first direction of the body 1. In this case, the number of central sheets in the multilayer sheet 1*c* disposed between the uppermost sheet 1*a* of the body 1 and the lowermost sheet 1*b* thereof is not a predetermined number, but may be adjusted by taking into account limitations on the thickness of a finally completed inductor and an inductance value desired for the completed inductor according to a product specification.

Next, since the multilayer electronic component 100 of FIGS. 1 and 2 includes different coils 2, a coil of FIG. 1 and a coil of FIG. 2 will be sequentially described.

First, referring to FIG. 1, the coil 2 may include the uppermost coil pattern 21 disposed on a top surface of the uppermost sheet 1*a*, the lowermost coil pattern 22 disposed on a bottom surface of the lowermost sheet 1*b*, and side coil patterns 23 and 24 disposed on edges of the multilayer sheet 1*c* disposed between the uppermost sheet 1*a* and the lowermost sheet 1*b* (e.g., the side coil patterns 23 and 24 may be disposed on side surfaces of the body 1).

The uppermost coil pattern 21, the lowermost coil pattern 22, and the side coil patterns 23 and 24 may be disposed to be electrically connected in series with each other, thereby forming a magnetic circuit having a single magnetic core.

The uppermost coil pattern 21 may include a plurality of central coil patterns each extending between and connecting both end portions of the uppermost sheet 1*a* opposing each other in the third direction of the body 1. The uppermost coil pattern 21 may further include a first lead coil pattern 211 and a second lead coil pattern 212 each disposed to be in contact with a respective end portion of the end portions of the uppermost sheet 1*a* opposing each other in the second direction of the body.

Next, the lowermost coil pattern 22 may include a plurality of central coil patterns each extending between and connecting both end portions of the lowermost sheet 1*b* opposing each other in the third direction of the body 1.

The side coil patterns 23 and 24 may each include a plurality of central coil patterns each disposed to extend between and be connected to the central coil patterns of the uppermost coil pattern 21 and the central coil patterns of the lowermost coil pattern 22.

Next, referring to FIG. 2, the coil 2 may include the uppermost coil pattern 21 disposed on a top surface of the uppermost sheet 1*a*, the lowermost coil pattern 22 disposed on a bottom surface of the lowermost sheet 1*b*, and the side coil patterns 23 and 24 disposed on edges of the multilayer sheet 1*c* disposed between the uppermost sheet 1*a* and the lowermost sheet 1*b*.

The uppermost coil pattern 21, the lowermost coil pattern 22, and the side coil patterns 23 and 24 may be disposed to be electrically connected in series with each other, thereby forming a magnetic circuit having a single magnetic core.

The uppermost coil pattern 21 may include a plurality of central coil patterns each extending between and connecting both end portions of the uppermost sheet 1*a* opposing each other in the third direction of the body 1. The uppermost coil pattern 21 may further include the first lead coil pattern 211 disposed to be in contact with one of the two end portions of the uppermost sheet 1*a* opposing each other in the second direction of the body 1.

The lowermost coil pattern 22 may include a plurality of central coil patterns each extending between and connecting both end portions of the lowermost sheet 1*b* opposing each other in the third direction of the body 1, and the second lead coil pattern 212 disposed to be in contact with one of the two end portions of the lowermost sheet 1*b* opposing each other in the second direction of the body 1.

The side coil patterns 23 and 24 may each include a plurality of central coil patterns each disposed to extend between and be connected to the central coil patterns of the uppermost coil pattern 21 and the central coil patterns of the lowermost coil pattern 22.

Meanwhile, the sheets included in the body 1 of FIGS. 1 and 2 may have shape anisotropy, and may include magnetic powder particles of which the major axis is disposed to be aligned in one direction of the sheet (e.g., in a direction parallel to the second direction of the body 1).

Figure 12:
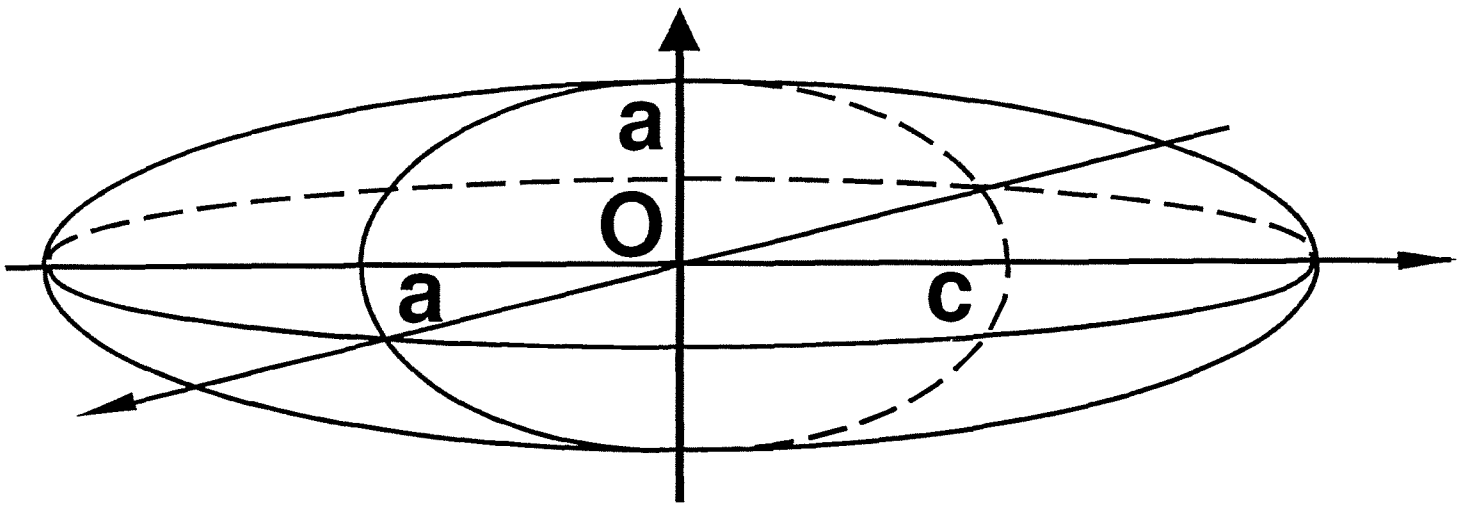
FIG. 12 shows a coordinate system associated with a magnetic powder particle having shape anisotropy.

When the magnetic powder particles have shape anisotropy, magnetic flux of a magnetic field may be concentrated in one direction referenced as the major axis of the magnetic powder particles. A detailed mechanism thereof will be described with reference to the following Equation 1 and a coordinate system associated with Equation 1 and shown in FIG. 12.

$$Ks=\tfrac{1}{2}(Na-Nc)M^2 \qquad \text{[Equation 1]}$$

(where, Ks is shape anisotropy, Na is a demagnetizing field coefficient for magnetization of an axis a, Nc is a demagnetizing field coefficient for magnetization of an axis c, and $M^2$ is magnetization strength).

According to the above Equation 1, in a case in which the magnetic powder particle has a spherical shape to allow Na and Nc to be equal to each other (Na=Nc), since Ks is 0 (zero), shape anisotropy may disappear. However, in a case in which the magnetic powder particle is flake-shaped to have a length extended on an axis C, a difference between Na and Nc may be increased and shape anisotropy may also be increased. In this case, since the demagnetizing coefficient Nc for magnetization of the axis C is decreased, it may be easy to perform magnetization on the axis C, but it may be difficult to perform magnetization in a direction perpendicular to the axis C.

FIGS. 3A-3C and 4A-4C will be referenced in relation to the description of the relationship between shape anisotropy and an easy magnetization axis of the magnetic powder particle.

Figure 3A:
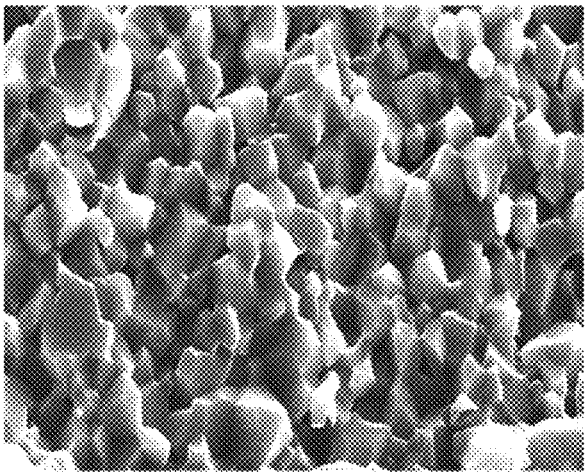
FIGS. 3A and 3B are schematic cross-sectional views of spherical magnetic powder particles according to the related art, and FIG. 3C schematically illustrates a magnetic field direction of the spherical magnetic powder particle of the related art.
Figure 3B:
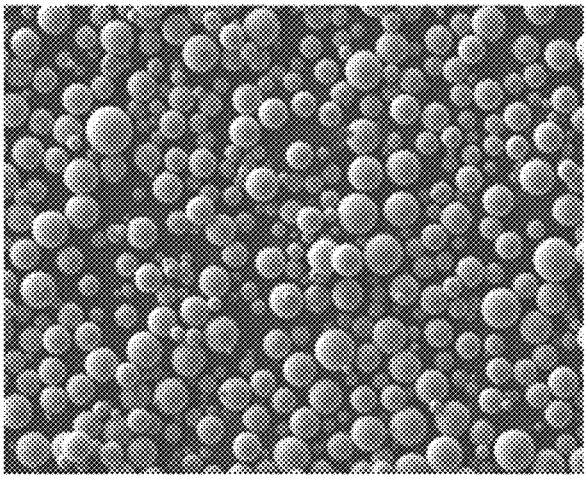
Figure 3C:
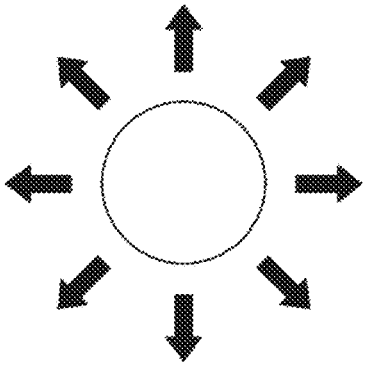
Figure 4A:
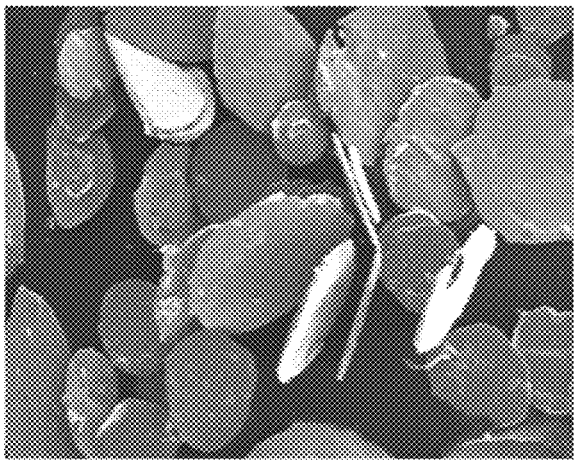
FIG. 4A is a cross-sectional view of magnetic powder particles contained in a body of the multilayer electronic component according to an example embodiment.
Figure 4B:
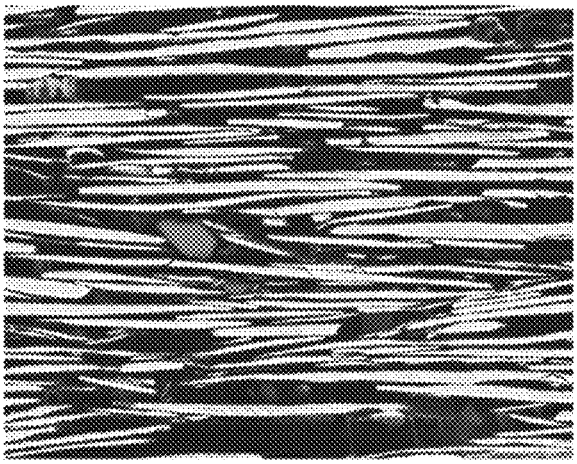
FIG. 4B is a cross-sectional view of a sheet in which the magnetic powder particles are aligned in one direction, and FIG. 4C schematically illustrates a magnetic field direction of a magnetic powder particle having shape anisotropy.
Figure 4C:
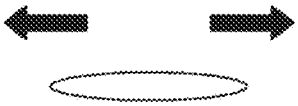

FIGS. 3A through 3C relate to sheets containing spherical magnetic powder particles according to the related art, and FIGS. 4A through 4C relate to sheets containing magnetic powder particles having shape anisotropy according to an example embodiment of the present disclosure.

First, FIG. 3A illustrates a cross-section of a ferrite core according to the related art, and FIG. 3B illustrates a cross-section of a spherical Fe—Si—Cr based metallic powder particle.

Further, FIG. 3C illustrates a direction of a magnetic field when the magnetic field is applied to the spherical magnetic powder particles of FIGS. 3A and 3B. In this case, if the magnetic field is applied to the ferrite powder particle or the Fe—Si—Cr based metallic powder particle having a spherical or close to spherical shape, since the magnetic field is uniformly distributed in all directions (and is not concentration in any particular direction), it is difficult to concentrate magnetic flux.

Next, FIG. 4A illustrates cross-sections of magnetic powder particles of a metal flake according to an example embodiment, and FIG. 4B illustrates a cross-section of a sheet in which the magnetic powders of the metal flake of FIG. 4A are aligned in one direction.

Further, FIG. 4C illustrates a direction of a magnetic field when the magnetic field is applied to the magnetic powder particle of FIG. 4A. In this case, the magnetic powder particles according to an example embodiment may have shape anisotropy as shown in FIG. 4A, and major axes of the magnetic powders may be aligned in one direction of the body as shown in FIG. 4B.

The major axes of the magnetic powders are aligned in one direction of the body may mean that the major axes of the magnetic powders are aligned to be parallel to each other in one direction of a sheet within a plurality of individual sheets.

In the embodiments of FIGS. 4A-4C, only the magnetic powder particles have a form having shape anisotropy, and a material thereof is not limited. For example, the material of the magnetic powder may include one or more selected from iron (Fe), a Fe—Si based alloy, sendust (Fe—Si—Al), permalloy (Fe—Ni), a Fe—Si—Cr based alloy, and a Fe—Si—B—Cr based amorphous alloy.

For example, the magnetic powder may have a plate shape, or a long strip shape.

Next, referring to FIGS. 5A through 5D, it may be appreciated that as a degree of shape anisotropy of the magnetic powder is increased, permeability of the inductor is increased accordingly.

Figure 5A:
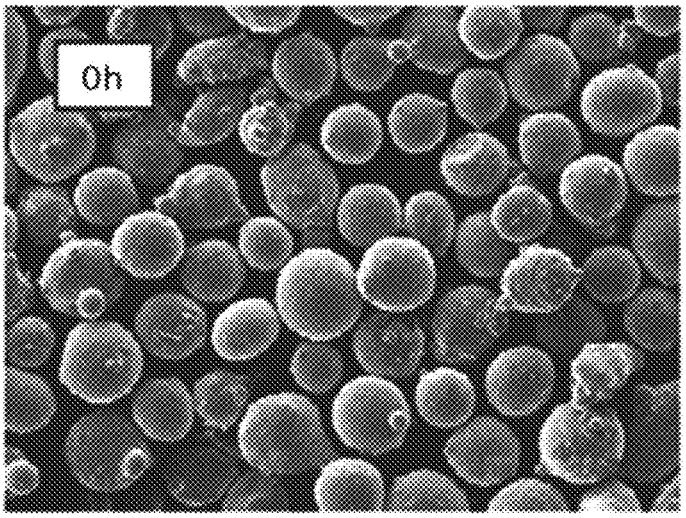
FIGS. 5A through 5D illustrate a degree of flaking and resulting permeability of magnetic powder particles at various time points during a flaking process.
Figure 5B:
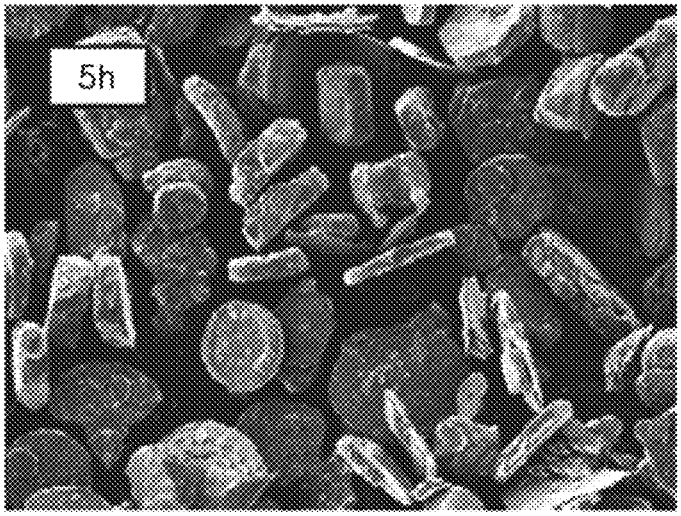
Figure 5C:
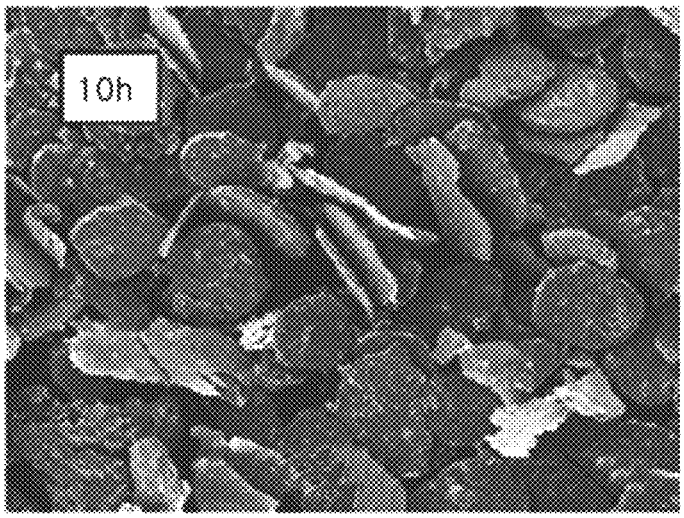

FIG. 5A is a cross-sectional view of the magnetic powder particles of the spherical Fe—Cr—Si—Al alloy, FIG. 5B is a cross-sectional view of the magnetic powder particles after performing a flaking process for the spherical magnetic powder particles for 5 hours, and FIG. 5C is a cross-sectional view of the magnetic powder particles after performing the flaking process for the spherical magnetic powder particles for 10 hours.

As seen in FIGS. 5A through 5C, as the length of time (e.g., number of hours) during which the flaking process is performed is increased, a degree of flaking of the magnetic powder particles may be increased.

A method for performing the flaking process is not particularly limited. For example, one of a ball milling method, an ultrasonic milling method, a bead milling method, and an attritor-based method may be used.

Figure 5D:
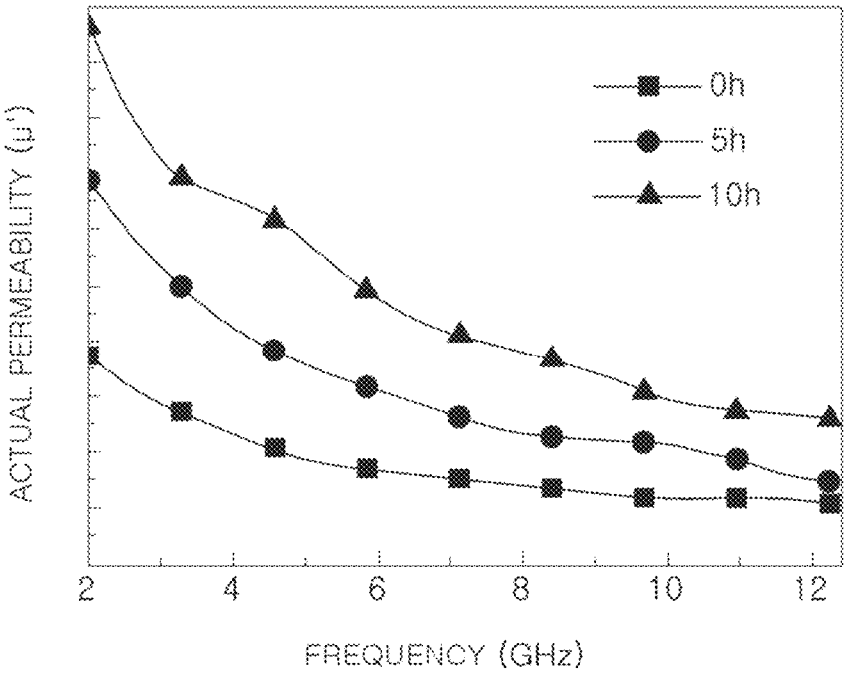

Next, FIG. 5D illustrates permeability of the respective magnetic powder particles of FIGS. 5A through 5C. It may be seen from FIG. 5D that as the degree of flaking of the magnetic powder particle is increased, permeability is also increased in a frequency band including both a high frequency and a low frequency.

Meanwhile, according to an example embodiment, the magnetic powder particles which are flake-shaped to have shape anisotropy may be aligned on the plurality of sheets in a certain direction, and the plurality of sheets may be sequentially stacked in the thickness direction of the body 1.

A technical effect obtained by forming the body 1 by aligning the flake-shaped magnetic powder particles on the plurality of sheets in the certain direction and then stacking the plurality of sheets, and a technical effect obtained by disposing the flake-shaped magnetic powder particles in a mold formed by a conventional die may be different from each other.

Specifically, in a case in which the body of the inductor is manufactured using the mold, a phenomenon in which the body swells in the height direction thereof due to a spring back phenomenon of the flake-shaped magnetic powder particles contained therein may occur, which may cause an occurrence of voids, and surface cracks may occur.

Further, since the voids occur, permeability may be decreased due to a decrease in density of the body.

Further, in a case in which the mold is used, since a relatively large amount of pressure is applied to the body during manufacturing, permeability may be decreased by external stress.

However, since the multilayer electronic component according to an example embodiment includes the body 1 in which the plurality of sheets containing the magnetic powder particles are stacked in the thickness direction thereof, the multilayer electronic component may avoid or prevent the negative effects such as the decrease in permeability, the surface cracks, and the like which may occur when the body is manufactured by the conventional mold, or the like, and may concentrate the magnetic flux.

Therefore, the body in which a better quality of magnetic flux is aligned may be provided by manufacturing the body by aligning the flake-shaped magnetic powder particles on the plurality of sheets and sequentially stacking the individual sheets containing the magnetic powder particles, instead of manufacturing the body by simply disposing the magnetic powder particles, which are flake-shaped, in the mold to have shape anisotropy, when the body of the multilayer electronic component according to an example embodiment is manufactured.

Next, FIGS. 6A through 6D are planar views schematically illustrating the coil 2 disposed on the external surface of the body 1 of FIG. 1.

The coil 2 may be disposed on the external surfaces of the body 1, and may include the uppermost coil pattern 21 disposed on a top surface of the uppermost sheet 1*a*, the lowermost coil pattern 22 on the lowermost sheet 1*b*, and the side coil patterns 23 and 24 disposed on edges of the multilayer sheet 1*c* between the uppermost sheet 1*a* and the lowermost sheet 1*b* and including a plurality of central sheets.

The uppermost coil pattern 21, the lowermost coil pattern 22, and the side coil patterns 23 and 24 of the coil 2 may be disposed so as to be electrically connected in series with each other, thereby forming a single magnetic circuit.

Further, the coil 2 may be disposed on the external surfaces of the body 1, and the body may form a magnetic core disposed in a direction parallel to a direction in which major axes of the magnetic powder particles contained in the body are aligned.

As a result, the magnetic field resulting from current flow through the coil 2 may be concentrated in the direction of the major axis of the magnetic powder particles, and may thus be in alignment with the easy magnetization axis, such that high permeability may be secured.

A detailed description of the coil 2 will be provided with reference to a description of FIGS. 6A through 6D.

Figure 6A:
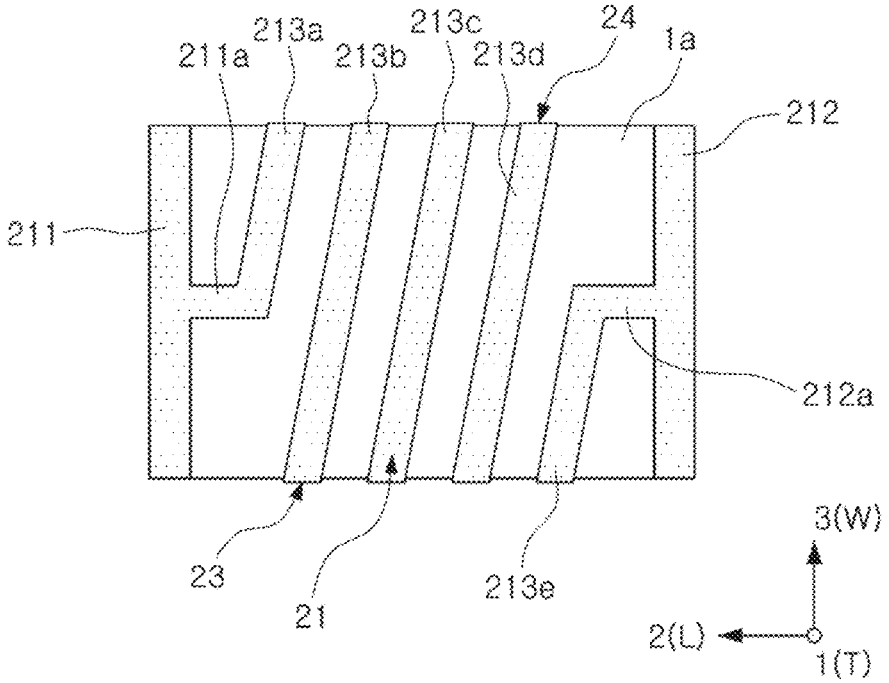
FIGS. 6A through 6D are schematic planar views illustrating coils disposed on respective external surfaces of a body of the multilayer electronic component of FIG. 1.
Figure 6B:
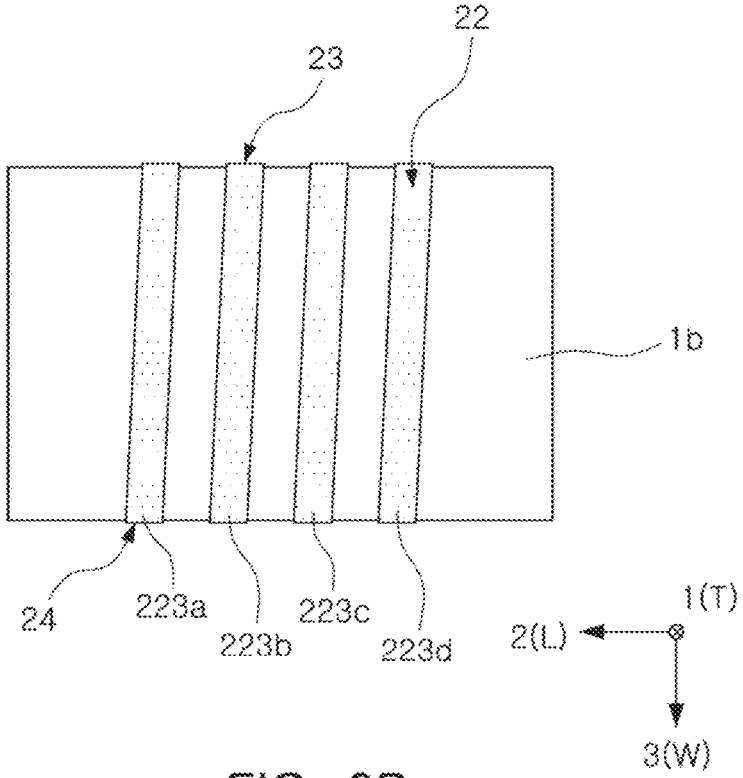

First, FIG. 6A illustrates the uppermost coil pattern 21 of the coil 2 that is disposed on the top surface of the uppermost sheet 1*a* of the body 1, and FIG. 6B illustrates the lowermost coil pattern 22 of the coil 2 that is disposed on the bottom surface of the lowermost sheet 1*b* of the body 1.

Referring to FIG. 6A, the uppermost coil pattern 21 may include the first and second lead coil patterns 211 and 212 each disposed to be in contact with a respective end portion of the two end portions of the uppermost sheet 1*a* opposing each other in the second direction of the body 1, and a plurality of central coil patterns 213*a*, 213*b*, 213*c*, 213*d*, and 213*e* connected to the first and second lead coil patterns 211 and 212 and disposed to be spaced apart from each other in the second direction of the body in a region between the first and second lead coil patterns 211 and 212.

In this case, the central coil pattern 213*a* that is closest to the first lead coil pattern 211 among the plurality of central coil patterns may be disposed to be connected to the first lead coil pattern 211 through a first connection portion 211*a*. Similarly, the central coil pattern 213*e* that is closest to the second lead coil pattern 212 among the plurality of central coil patterns may be disposed to be connected to the second lead coil pattern 212 through a second connection portion 212*a*.

The first and second connection portions 211*a* and 212*a* illustrate portions connecting the first and second lead coil patterns 211 and 212 and the central coil patterns to each other, and may be formed integrally with the first and second lead coil patterns 211 and 212 so as not to be specifically distinguished from the first and second lead coil patterns 211 and 212 when the patterns of the coil 2 are appropriately changed.

Referring to FIG. 6B, the lowermost coil pattern 22 may include a plurality of central coil patterns 223*a*, 223*b*, 223*c*, and 223*d* disposed to be spaced apart from each other in the second direction of the body 1.

The plurality of central coil patterns 223*a*, 223*b*, 223*c*, and 223*d* included in the lowermost coil pattern 22 may be disposed to be spaced apart from each other in the second direction of the body 1 and may have a plurality of strip shapes.

In this case, the plurality of central coil patterns 213*a*, 213*b*, 213*c*, 213*d*, and 213*e* of the uppermost coil pattern 21, and the plurality of central coil patterns 223*a*, 223*b*, 223*c*, and 223*d* of the lowermost coil pattern 22 may have a plurality of strip shapes each extending between and connecting both end portions opposing each other in the width direction of the body, and the number of strip shapes may be determined by taking into account a desired inductance value (or a number of windings of the coil 2), or the like, and is not limited to a predetermined number.

In this case, the strip shapes may also be disposed to be in parallel to the width direction of the body 1, and may also be disposed to be inclined at a predetermined angle with respect to the width direction of the body (the predetermined angle T may, in some examples, be within the range of 0<T<90°). The angle of the strip shapes may be appropriately adjusted by changing a design in a manufacturing process. However, in the case in which the strip shapes are disposed to be inclined at the predetermined angle with respect to the width direction of the body 1, since an area of a region on which the plurality of central coil patterns may be disposed may be further increased, the above-mentioned case in which the strip shapes are disposed to be inclined at the predetermined angle with respect to the width direction of the body may be advantageous when the number of windings intended to be implemented on the sheet is large.

Figure 6C:
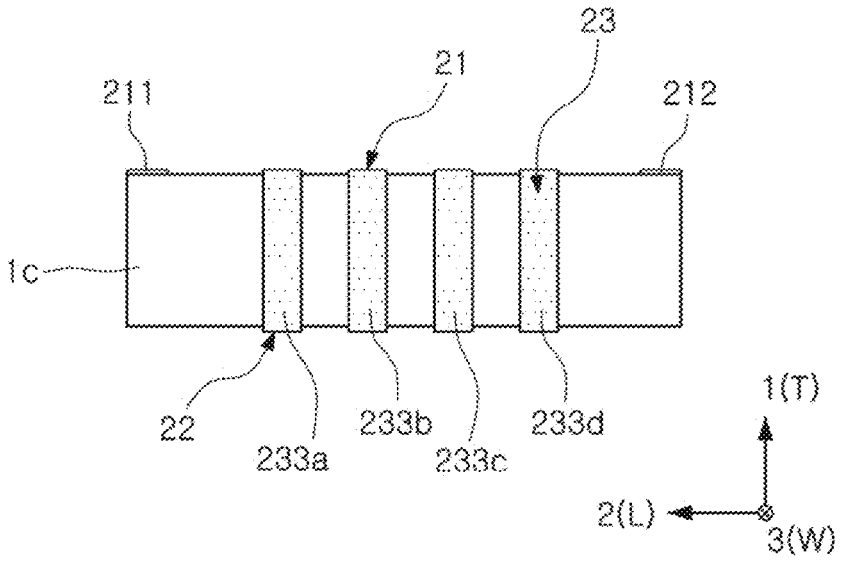
Figure 6D:
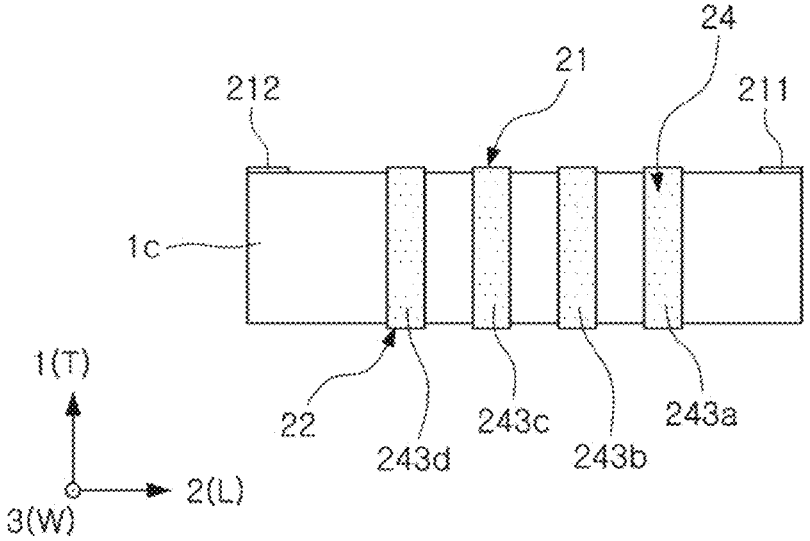

Next, FIG. 6C illustrates the side coil pattern 23 disposed on one edge of the plurality of central sheets 1*c* disposed between the uppermost sheet 1*a* and the lowermost sheet 1*b*, and FIG. 6D illustrates the side coil pattern 24 disposed on the other edge of the plurality of central sheets 1*c*.

The side coil patterns 23 and 24 may be each respectively disposed on a fifth surface and a sixth surface of the body opposing each other in the width direction of the body.

Referring to FIG. 6C, the side coil pattern 23 may include the plurality of central coil patterns 233*a*, 233*b*, 233*c*, and 233*d* disposed to be spaced apart from each other in the second direction of the body 1 while being perpendicular to the direction in which the major axis of the magnetic powder particle is aligned, and the central coil patterns 233*a*, 233*b*, 233*c*, and 233*d* may have strip shapes.

One end portion of each of the plurality of strip shapes of the central coil patterns 233*a*, 233*b*, 233*c*, and 233*d* may be connected to one end portion of a corresponding one of the plurality of central coil patterns of the uppermost coil pattern 21, and the other end portion of each of the plurality of strip shapes of the central coil patterns 233*a*, 233*b*, 233*c*, and 233*d* may be connected to one end portion of a corresponding one of the plurality of central coil patterns of the lowermost coil pattern 22.

Referring to FIG. 6D, the side coil pattern 24 may include the plurality of central coil patterns 243*a*, 243*b*, 243*c*, and 243*d* disposed to be spaced apart from each other in the second direction of the body 1 while being perpendicular to the direction in which the major axis of the magnetic powder particle is aligned, and the central coil patterns 243*a*, 243*b*, 243*c*, and 243*d* may have strip shapes.

One end portion of each of the plurality of strip shapes of the central coil patterns 243*a*, 243*b*, 243*c*, and 243*d* may be connected to one end portion of a corresponding one of the plurality of central coil patterns of the uppermost coil pattern 21, and the other end portion of each of the plurality of strip shapes of the central coil patterns 243*a*, 243*b*, 243*c*, and 243*d* may be connected to one end portion of a corresponding one of the plurality of central coil patterns of the lowermost coil pattern 22.

In this case, the number of central coil patterns in the side coil patterns 23 and 24 is not limited, but may be variously determined according to electrical characteristics such as a desired inductance value, and the like.

Further, intervals between the plurality of central coil patterns in the side coil patterns 23 and 24 that are spaced apart from each other in the second direction of the body 1 may be the same as each other.

The strip shapes of the plurality of central coil patterns in the side coil patterns 23 and 24 may be disposed at positions corresponding to each other on the fifth surface and the sixth surface of the body 1. In this case, the strip shapes of the central coil patterns of the uppermost and lowermost coil patterns 21 and 22 connected to the side coil patterns 23 and 24 may be disposed to be parallel to the width direction of the body 1.

Meanwhile, the positions at which the strip shapes of the plurality of central coil patterns in the side coil pattern 23 are disposed on the fifth surface of the body 1, and the positions at which the strip shapes of the plurality of central coil patterns in the side coil pattern 24 are disposed on the sixth surface of the body 1 may also not correspond to each other. In this case, the strip shapes in the central coil patterns of the uppermost and lowermost coil patterns 21 and 22 connected to the side coil patterns 23 and 24 may be disposed to be inclined at a predetermined angle with respect to the third direction of the body 1.

According to an example embodiment, the side coil patterns 23 and 24 are disposed to be perpendicular to the direction in which the flake-shaped magnetic powder particles contained in the body are aligned and the magnetic field is formed, whereby the magnetic flux of the multilayer inductor may be concentrated, and permeability may be improved.

Meanwhile, the plurality of strip shapes of the plurality of central coil patterns in the side coil patterns 23 and 24 may also be changed so as not to be perpendicular to the direction in which the major axis of the magnetic powder particles are aligned. Instead, the plurality of strip shapes of the plurality of central coil patterns in the side coil patterns 23 and 24 may have a predetermined angle with respect to a vertical direction, and to be obliquely disposed (not illustrated).

However, also in this case, the side coil patterns 23 and 24 may be disposed to be perpendicular to the direction in which the major axis of the magnetic powder particles are aligned and may be disposed to only have an incline at which a concentration trend of the magnetic field due to shape anisotropy of the magnetic powder particle may be maintained.

Next, FIGS. 7A through 7D are planar views schematically illustrating the coil 2 disposed on the external surface of the body 1 of FIG. 2.

Figure 7A:
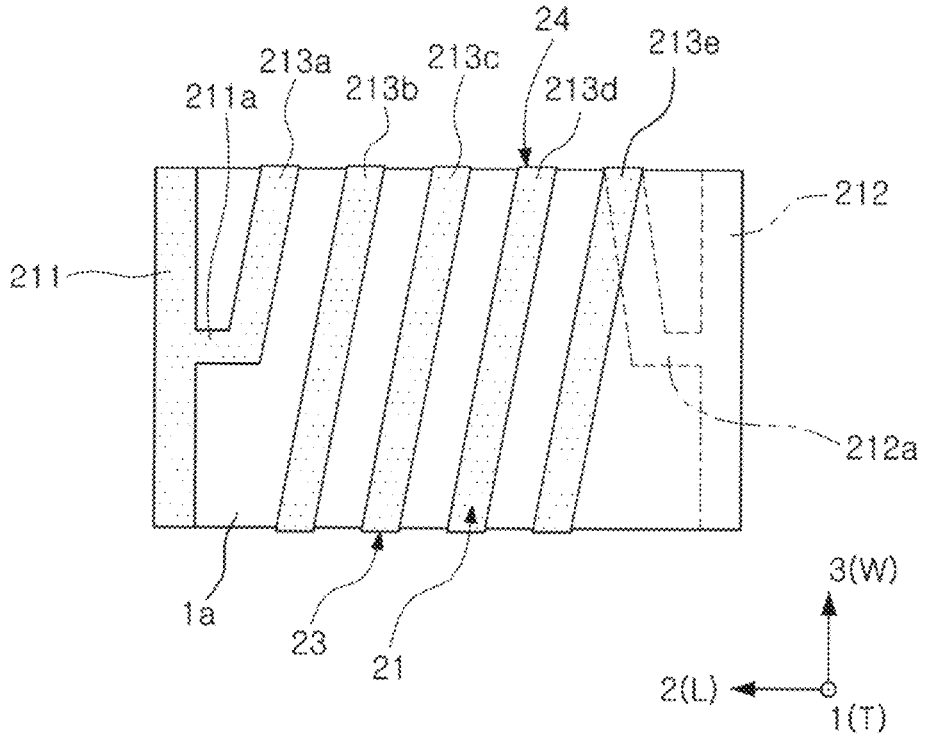
FIGS. 7A through 7D are schematic planar views illustrating coils disposed on respective external surfaces of a body of the multilayer electronic component of FIG. 2.
Figure 7B:
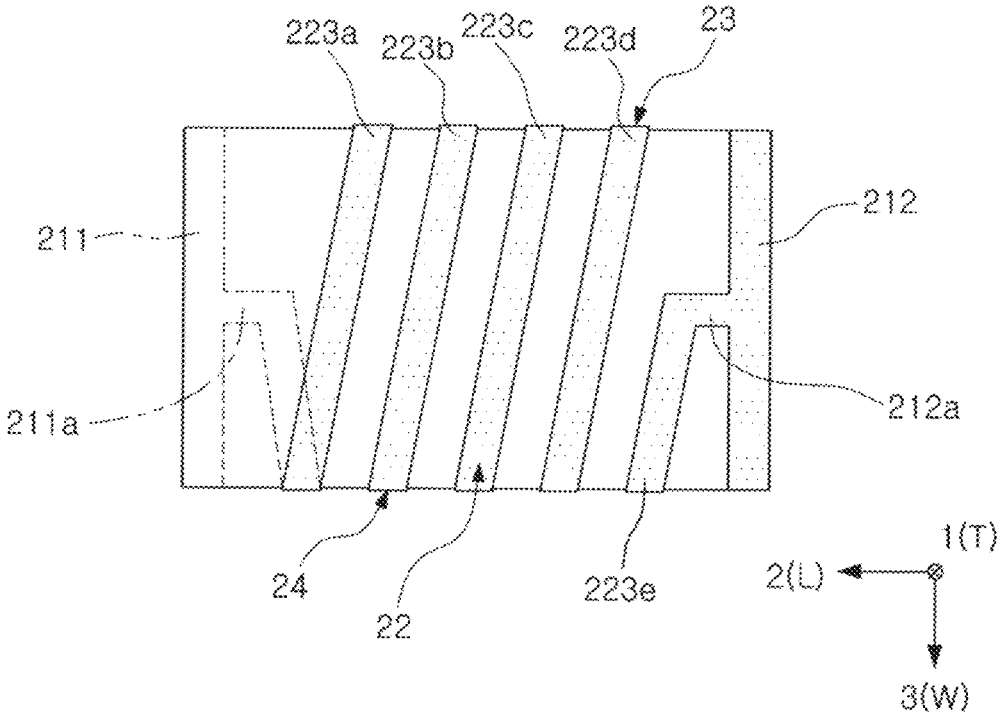
Figure 7C:
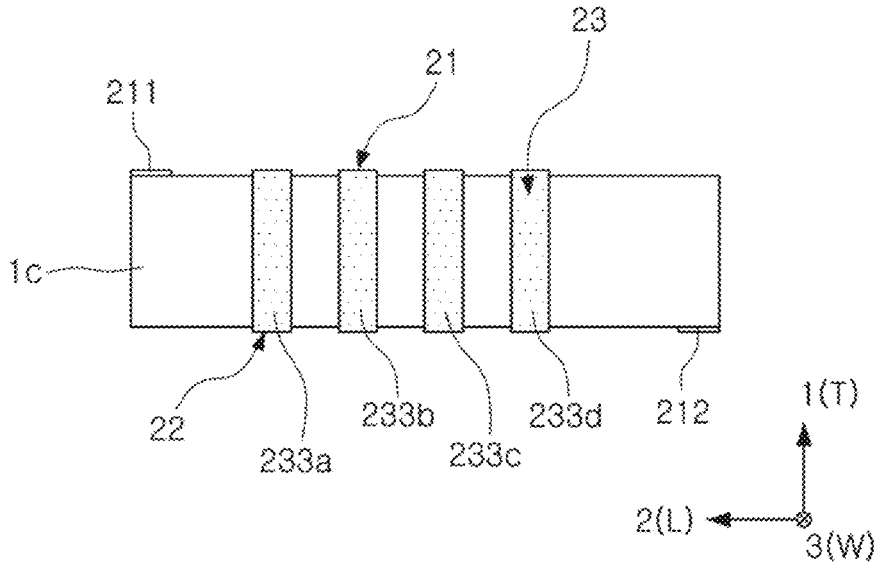
Figure 7D:
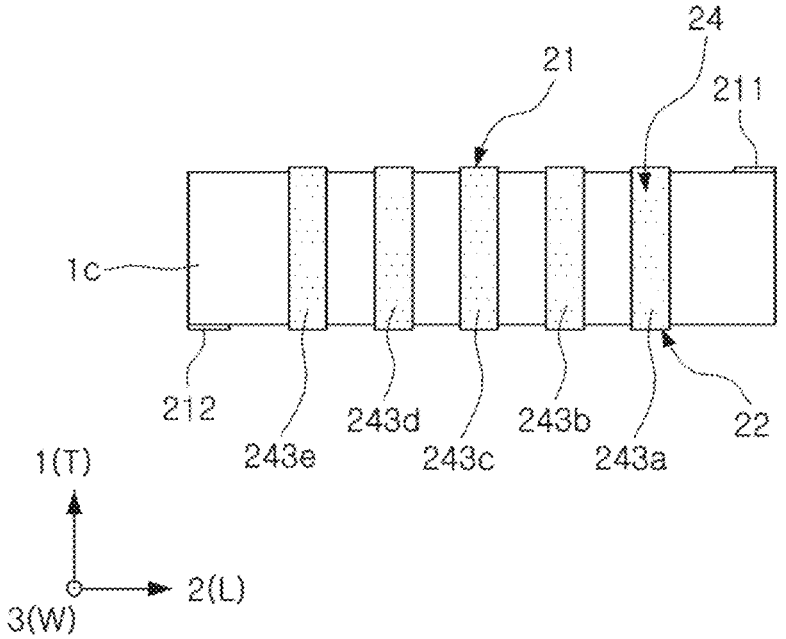

In this case, FIGS. 7C and 7D are schematic planar views of the side coil patterns 23 and 24 of coil 2, respectively. Since FIGS. 7C and 7D are generally similar to FIGS. 6C and 6D, a detailed description thereof will be omitted.

FIG. 7A illustrates the uppermost coil pattern 21 of the coil 2 disposed on the top surface of the uppermost sheet 1*a* of the body 1, and FIG. 7B illustrates the lowermost coil pattern 22 of the coil 2 disposed on the bottom surface of the lowermost sheet 1*b* of the body 1.

Referring to FIG. 7A, the uppermost coil pattern 21 may include the first lead coil pattern 211 disposed to be in contact with one of two end portions of the uppermost sheet 1*a* opposing each other in the second direction of the body 1, and the plurality of central coil patterns 213*a*, 213*b*, 213*c*, 213*d*, and 213*e* connected to the first lead coil pattern 211 and disposed to be spaced apart from each other in the second direction of the body 1. In this case, the central coil pattern 213*a* that is closest to the first lead coil pattern 211 among the plurality of central coil patterns may be disposed to be connected to the first lead coil pattern 211 through the first connection portion 211*a*.

Referring to FIG. 7B, the lowermost coil pattern 22 may include the second lead coil pattern 212 disposed to be in contact with one of two end portions of the lowermost sheet 1*b* opposing each other in the second direction of the body 1, and the plurality of central coil patterns 223*a*, 223*b*, 223*c*, 223*d*, and 223*e* connected to the second lead coil pattern 212 and disposed to be spaced apart from each other in the second direction of the body 1.

The plurality of central coil patterns 223*a*, 223*b*, 223*c*, 223*d*, and 223*e* included in the lowermost coil pattern 22 may be disposed to be spaced apart from each other in the second direction of the body, and spacing intervals thereof may be the same as each other.

The plurality of central coil patterns 213*a*, 213*b*, 213*c*, 213*d*, and 213*e* of the uppermost coil pattern 21, and the plurality of central coil patterns 223*a*, 223*b*, 223*c*, 223*d*, and 223*e* of the lowermost coil pattern 22 may have a plurality of strip shapes that each extend between and connect end portions of a respective one of the uppermost and lowermost sheets 1*a* and 1*b* opposing each other in the width direction of the body.

In this case, the strip shapes may also be disposed to be parallel to the width direction of the body 1, and may also be disposed to be inclined at a predetermined angle with respect to the width direction of the body (the predetermined angle T may, in some examples, be within the range of $0<T<90°$). The angle of the strip shapes may be appropriately adjusted by changing a design in a manufacturing process. However, in the case in which the strip shapes are disposed to be inclined at the predetermined angle with respect to the width direction of the body 1, since an area of a region on which the plurality of central coil patterns may be disposed may be further increased, the above-mentioned case in which the strip shapes are disposed to be inclined at the predetermined angle with respect to the width direction of the body may be advantageous when the number of windings intended to be implemented on the sheet is large.

According to an example embodiment, any appropriate method may be used for manufacturing the patterns of the coil 2 described above, and the detailed method for implementing the patterns of the coil 2 is not limited to any specific method.

As a detailed example, the patterns of the coil 2 may be printed on both edges of the plurality of central sheets 1*c* other than the uppermost and lowermost sheets 1*a* and 1*b*, among the plurality of sheets in which the major axis of the magnetic powder particles having shape anisotropy is aligned in one direction, using silver (Ag) paste. Subsequently, the lowermost sheet 1*b* on which the patterns are not printed may be disposed on the bottom surface of the central sheet 1*c* on which the patterns are printed, the plurality of central sheets 1*c* on which the patterns are printed may be sequentially stacked, and the uppermost sheet 1*a* on which the patterns are not printed may be then disposed on the top surface of the stacked sheets. Next, processes of applying a photoresist, masking, exposing and developing the photoresist, etching the patterns using the photoresist, and delaminating the photoresist may be performed on the top surface of the uppermost sheet 1*a* and the bottom surface of the lowermost sheet 1*b* of the multilayer body 1, and a method utilizing via electrodes may be used to form a connection between the stacked sheets, but the method of forming the connection between the stacked sheets is not limited thereto.

As such, when the patterns on the edges of the body 1 are formed by the printing process, and the patterns on the top surface and the bottom surface of the body 1 are formed by the etching process, thicknesses of the coil patterns on the top surface and the bottom surface of the body 1 may be thicker than thicknesses of the coil patterns on the edges of the body 1. This may be advantageous since sufficient thickness may be secured in the coils of the top surface and the bottom surface when the coil patterns are formed using both the printing process and the etching process.

In addition, as a another example, after a multilayer body 1 including the plurality of sheets is formed and a printing is performed on the top surface, the bottom surface, and the edges of the body using silver (Ag) paste, the patterns may also be formed by plating, but the present disclosure is not limited thereto.

As a another example, after the multilayer body 1 including the plurality of sheets is formed and grooves of a coil shape are formed to have the coil patterns of the shapes described above, the coils may be disposed in the grooves using an electroless plating method, but the present disclosure is not limited thereto.

Figure 8:
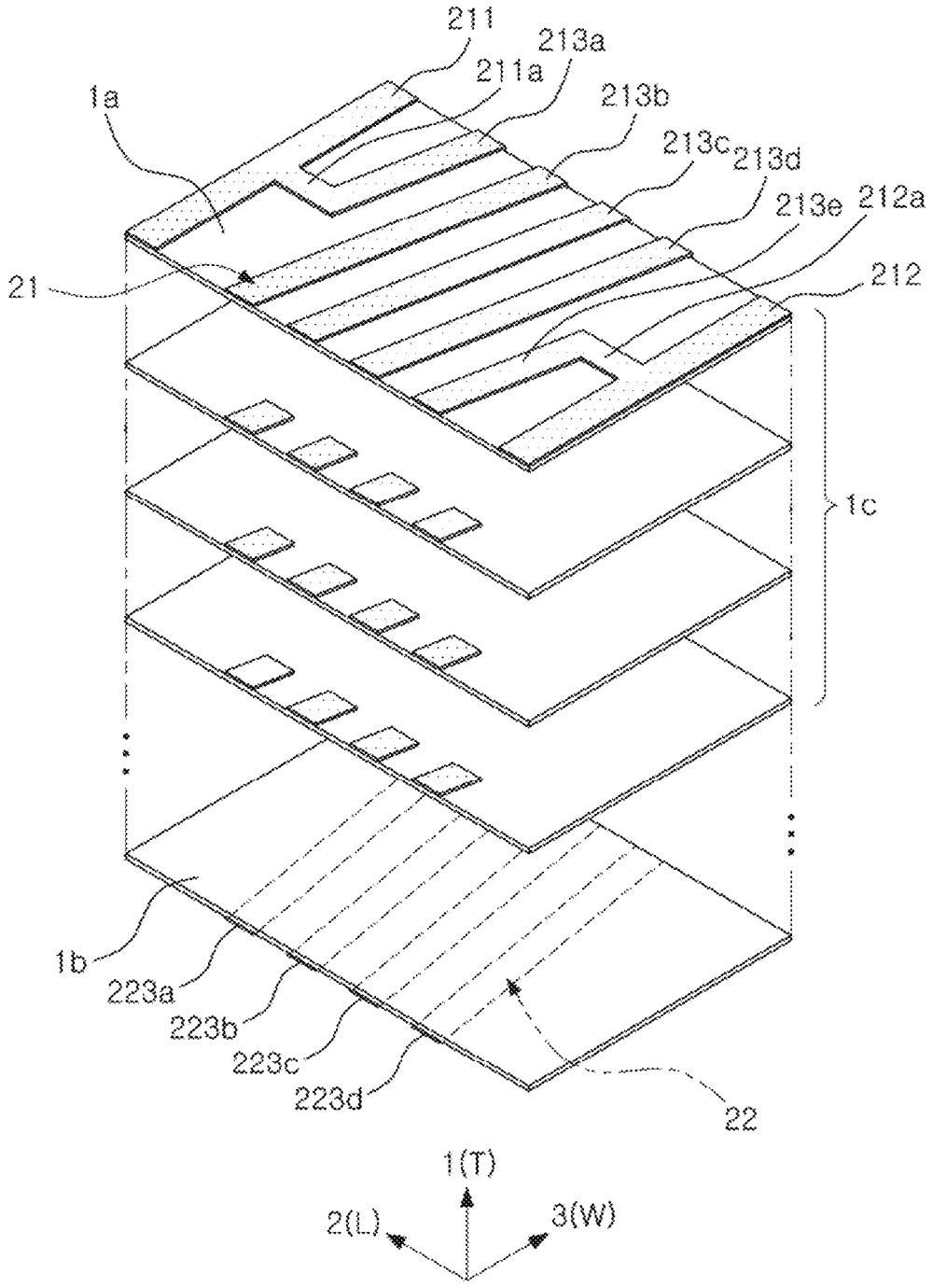
FIG. 8 is an exploded perspective view of a plurality of sheets of the multilayer electronic component of FIG. 1.
Figure 9:
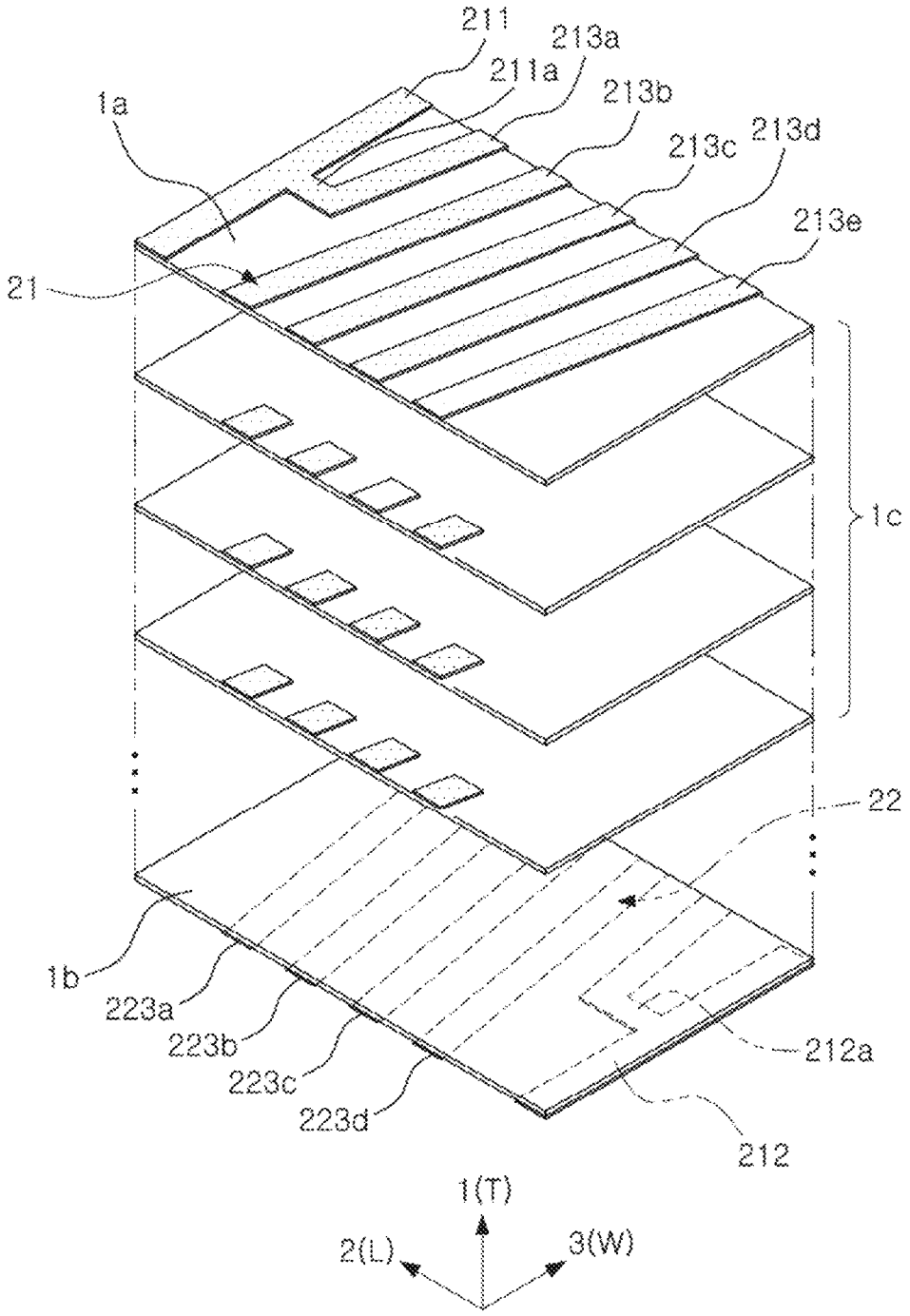
FIG. 9 is an exploded perspective view of a plurality of sheets of the multilayer electronic component of FIG. 2.

Meanwhile, FIGS. 8 and 9 relate to a method for printing coil patterns on the plurality of sheets including the uppermost and lowermost sheets 1*a* and 1*b* using conductive paste, among various methods for manufacturing the coil patterns of FIGS. 1 and 2, and illustrate an exploded perspective view of the plurality of sheets in the body of FIGS. 1 and 2, respectively.

As the method of printing the coil patterns using the conductive paste, a screen printing method, a gravure printing method, or the like, may be used. However, the present disclosure is not limited thereto.

A conductive metal contained in the conductive paste may be silver (Ag), nickel (Ni), and copper (Cu), or alloys thereof, but is not limited thereto.

Referring to FIG. 8, the uppermost coil pattern 21 on the uppermost sheet 1*a* may include the first and second lead coil patterns 211 and 212 disposed to be in contact with two end portions of the uppermost sheet opposing each other in a length direction of the body 1, and the plurality of central coil patterns 213*a*, 213*b*, 213*c*, 213*d*, and 213*e* connected to the first and second lead coil patterns 211 and 212 and disposed to be spaced apart from each other in the length direction of the body 1 in the region between the first and second lead coil patterns 211 and 212. Further, the lowermost coil pattern 22 on the lowermost sheet 1*b* may include the plurality of central coil patterns 223*a*, 223*b*, 223*c*, and 223*d* disposed to be spaced apart from each other in the length direction of the body 1.

Meanwhile, the multilayer sheet 1*c* including the plurality of central sheets disposed between the uppermost and lowermost sheets 1*a* and 1*b* may include the side coil patterns. In this case, the first side coil patterns 23 and the second side coil patterns 24 may be disposed at both end portions opposing each other in a width direction of the body 1, and may be printed on the top surfaces of the plurality of central sheets to form the side coil patterns 23 and 24.

The number of first and second side coil patterns may be determined according to the number of windings to be implemented, and is not limited to any particular number.

The first side coil patterns 23 may be formed by printing a plurality of polygons to be parallel to each other on one of the two end portions in the width direction of the central sheet on the top surface of each central sheet using the conductive paste. Further, the second side coil patterns 24 may be formed by printing a plurality of polygons to be parallel to each other on the other end portion opposing one end portion at which the first side coil patterns 23 are disposed, using the conductive paste.

Specifically, the first side coil patterns 23 disposed at one end portion of the two end portions of the central sheets may include a plurality of polygonal patterns, and the polygonal patterns may be spaced apart from each other by a predetermined interval in the length direction of the body 1 while being extended from the one end portion of the central sheet to an inner side thereof.

Similarly, the second side coil patterns 24 (not illustrated) disposed at the other end portion of the two end portions of the central sheets may include a plurality of polygonal patterns, and the polygonal patterns may be spaced apart from each other by a predetermined interval in the length direction of the body 1 while being extended from the other end portion of the central sheet to an inner side thereof.

An extended length of the polygonal patterns from the both end portions of the central sheets to the inner side thereof is not limited, and may be appropriately set according a manufacturing process or a design process.

Extended intervals of the plurality of polygonal patterns on both end portions of the central sheet may be the same as each other, but are not limited thereto. As the interval is small, a large number of coil windings may be secured.

Meanwhile, a width of the polygon may be equal to a length thereof extended in the second direction of the body 1, and the width of the polygon within the first and second side coil patterns 23 and 24 disposed on the top surface of one central sheet of the plurality of central sheets may be the same as, or smaller than the width of the polygon within the first and second side coil patterns 23 and 24 disposed on the top surface of another central sheet, positioned immediately below the central sheet. When the width of the polygon within the first and second side coil patterns 23 and 24 on the top surface of the central sheet disposed below among the neighboring central sheets is printed to be larger, both end portions of the sheets in the width direction of the sheets and the length direction thereof may be unintentionally misaligned from each other during the process of stacking the plurality of sheets to thereby cause an occurrence of error or a step portion. In the case in which a larger width of the polygon printed on the sheet disposed immediately below the central sheet is secured, the error or the step portion of the coil patterns may be offset without an additional process.

In addition, the polygonal pattern may have a rectangular shape, pentagonal shape, a triangular shape, and the like depending on the manufacturing process and the design, and may also be changed to other various shapes such as a circular shape, oval shape, and the like.

Meanwhile, the plurality of polygonal patterns between adjacent sheets of the plurality of central sheets may be electrically connected through vias disposed in predetermined positions within (or underneath) the polygonal patterns. One end portion of the central coil pattern of the uppermost coil patterns 21 may be electrically connected to the first side coil pattern 23 on the central sheet disposed immediately below the uppermost sheet 1*a* through a via (e.g., a via extending through the uppermost sheet 1*a*), and the other end portion of the central coil pattern may be electrically connected to the second side coil pattern 24 on the central sheet disposed immediately below the uppermost sheet 1*a* through another via (e.g., another via extending through the uppermost sheet 1*a*).

Similarly, one end portion of the central coil pattern of the lowermost coil patterns 22 may be electrically connected to the first side coil pattern 23 on the central sheet disposed immediately above the lowermost sheet 1*b* through a via (e.g., a via extending through the lowermost sheet 1*b*), and the other end portion of the central coil pattern may be electrically connected to the second side coil pattern 24 on the central sheet disposed immediately above the lowermost sheet 1*b* through another via (e.g., another via extending through the lowermost sheet 1*b*).

Next, referring to FIG. 9, the uppermost coil pattern 21 on the upper sheet 1*a* may include the first lead coil pattern 211 disposed to be in contact with one of two end portions of the uppermost sheet 1*a* opposing each other in the length direction of the body 1, and the plurality of central coil patterns 213*a*, 213*b*, 213*c*, 213*d*, and 213*e* connected to the first lead coil pattern 211 and disposed to be spaced apart from each other in the length direction of the body 1. In addition, the lowermost coil pattern 22 on the lowermost sheet 1*b* may include the second lead coil pattern 212 disposed to be in contact with one of two end portions of the lowermost sheet 1*b* opposing each other in the length direction of the body 1, and the plurality of central coil patterns 223*a*, 223*b*, 223*c*, and 223*d* connected to the second lead coil pattern 212 and disposed to be spaced apart from each other in the length direction of the body 1.

As compared to FIG. 8, FIG. 9 differs from FIG. 8 in that the second lead coil pattern 212 is disposed on the bottom surface of the lowermost sheet 1*b*, not on the top surface of the uppermost sheet 1*a*, and all other configurations are the same as those of FIG. 8. Therefore, a detailed description thereof will be omitted.

Figure 10:
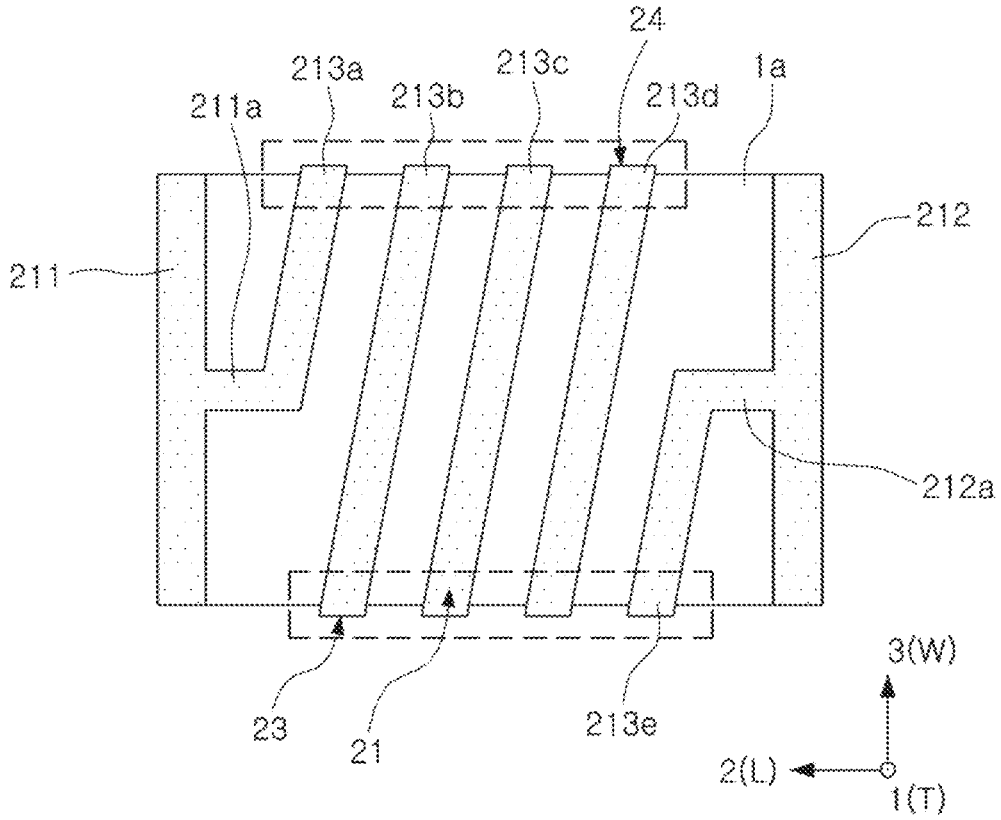
FIG. 10 is a schematic view of the multilayer electronic component of FIG. 1.

FIG. 10 illustrates a schematic view of the multilayer electronic component of FIG. 1, and FIG. 10 is regarded as being slightly exaggerated for clarity.

Referring to FIG. 10, the coil 2 may be disposed so that a surface thereof is exposed to the external surfaces of the body 1, particularly, the fifth surface and the sixth surface opposing each other in the width direction of the body. The coil 2 is disposed with the surface thereof exposed such that external surfaces of the coils 2 disposed on the fifth surface and the sixth surface of the body 1 are not covered by the body 1 containing the magnetic powder particles. Nonetheless, the coil does not necessarily protrude from the external surfaces of the body 1 as illustrated in FIG. 10. For example, depending on a method for disposing the coil 2 on the body 1, the coil 2 may have a shape protruding from the external surfaces of the body 1 while having a step portion, or may be disposed so as not to be covered by the body 1 while being disposed without the step portion between the external surfaces of the body 1 and the external surfaces of the coil 2 (e.g., external surfaces of the body 1 and coil 2 may be flush with each other, for example on the fifth and sixth surfaces of the body 1).

In a case in which the external surfaces of the coil 2 disposed on the fifth surface and the sixth surface of the body are embedded in the body 1, since the magnetic field of the coil 2 is not emitted externally of the body 1, an open magnetic circuit may not be formed and a closed magnetic circuit may be formed. As a result, the magnetic field may not be emitted externally, and a recognition distance of the magnetic field may not be increased.

According to the multilayer electronic component having the structure described above, the magnetic flux may be increased by concentrating the magnetic field in the magnetic powder particles contained in the sheet and having major axes aligned in one direction. As a result, a size of the multilayer electronic component may be decreased, and permeability and the recognition distance may be increased at the same time by concentrating the magnetic field in the direction of the easy magnetization axis of the magnetic powder particles.

Multilayer Chip Antenna

According to another example embodiment, a multilayer chip antenna may include the multilayer electronic component having the body within the multilayer electronic component as a core part, and the coil as a coil part.

The multilayer chip antenna may be used for near field communications (NFC), magnetic secure transmissions (MST), and the like, and may generally include a coil part and a core part, wherein the coil part may serve to convert an electrical signal into an electromagnetic signal, and the core part may serve to prevent a decrease in a recognition distance by a demagnetizing field.

The core part of the multilayer chip antenna may be a body including magnetic powder particles having shape anisotropy, and the body may include a stack of a plurality of sheets in which major axes of the magnetic powder particles contained therein are aligned in a same direction. In addition, the coil part of the multilayer chip antenna may be disposed on an external surface of the core part, and may form a single magnetic circuit.

The multilayer chip antenna may be used as a main antenna and/or a sub-antenna in electronic devices.

In electronic devices in which the multilayer chip antenna according to an example embodiment is used as the main antenna, the multilayer chip antenna may be mounted at any position within the electronic component thanks to a miniaturized size, unlike a main loop antenna according to the related art which needs to be disposed on a surface of a battery or a rear cover of a cell phone because of the relatively large size thereof.

Meanwhile, in electronic devices in which the multilayer chip antenna according to an example embodiment is used as the sub-antenna, the multilayer chip antenna may be connected to the main loop antenna in series (e.g., as illustratively shown in FIG. 11) or in parallel according to the related art, thereby assisting in improving the recognition distance.

Figure 11:
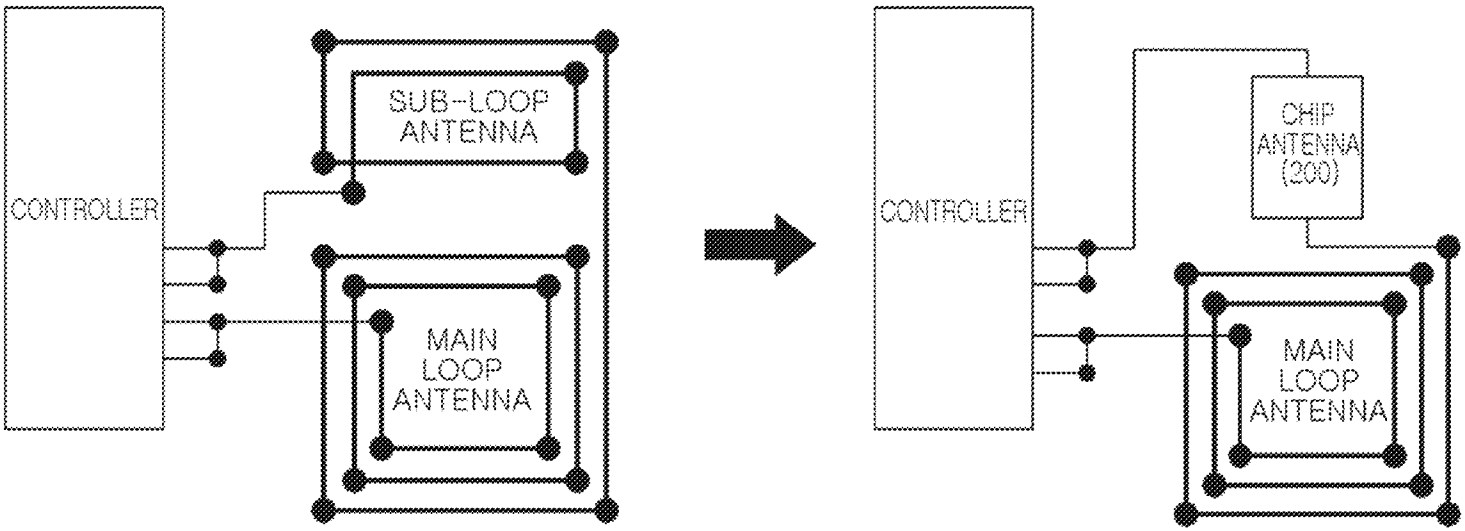
FIG. 11 illustrates a multilayer chip antenna according to another example embodiment in the present disclosure.

FIG. 11 illustrates a the multilayer chip antenna 200 used to replace a sub-loop antenna provided in an electronic device in accordance with the related art, to thereby be connected in series with the main loop antenna.

Since the multilayer chip antenna 200 may concentrate the magnetic flux and improve the recognition distance, the multilayer chip antenna 200 may be more sensitive to changes in a distance to or an angle with a recognition object when disposed together with the main loop antenna as illustrated in FIG. 11.

Except for the above-mentioned description, a description of characteristics overlapped with those of the coil component according to the example embodiment described above will be omitted.

As set forth above, according to the example embodiments in the present disclosure, the multilayer electronic component may exhibit increased magnetic flux by concentrating the magnetic field of the powder particles contained in the sheets and having major axes aligned in one direction, and the multilayer chip antenna including the same may be provided.

According to an example embodiment, the multilayer electronic component and multilayer chip antenna are provided having the reduced size while having the increased permeability and recognition distance by concentrating the magnetic field in the easy magnetization axis direction of magnetic powder particles disposed therein.

The present disclosure is not limited to the above-mentioned example embodiments and the accompanying drawings, but is defined by the accompanying claims. Accordingly, various substitutions, modifications, and alterations may be made within the scope of the present disclosure without departing from the spirit of the prevent disclosure defined by the accompanying claims.

Meanwhile, a term "example" used in the present disclosure does not mean the same example, but is provided in order to emphasize and describe different unique features. However, the above suggested examples may be implemented so as to combine features from various examples. For example, even though particulars described in a specific example are not described in another example, it may be understood that the particulars may be included in the other example unless described otherwise.

Meanwhile, terms used in the present disclosure are used only in order to describe an example rather than limiting the scope of the present disclosure. Here, singular forms include plural forms unless specified otherwise in a context.

While example embodiments have been shown and described above, it will be apparent to those skilled in the art that modifications and variations could be made without departing from the scope of the present invention as defined by the appended claims.

What is claimed is:

1. A multilayer electronic component comprising:

a body including a plurality of planar sheets each containing magnetic powder particles each having shape anisotropy with a major axis thereof aligned with a plane of the planar sheet and aligned with major axes of other magnetic powder particles within the body; and a coil including an uppermost coil pattern disposed on a top surface of an uppermost sheet among the plurality of sheets, a lowermost coil pattern disposed on a bottom surface of a lowermost sheet among the plurality of sheets, and side coil patterns disposed on edges of central sheets disposed between the uppermost sheet and the lowermost sheet in a central portion of the body, wherein the major axes of the magnetic powder particles are aligned with planes of the planar sheets and with a direction of a magnetic field through a center of the coil resulting from current flow through the coil, and the uppermost coil pattern or the lowermost coil pattern is formed to be thicker than the side coil patterns.

2. The multilayer electronic component of claim 1, wherein the uppermost coil pattern, the lowermost coil pattern, and the side coil patterns are electrically connected in series with each other and form a magnetic circuit.

3. The multilayer electronic component of claim 1, wherein the coil is disposed on external surfaces of the body, and the body forms a magnetic core having a long axis parallel to the major axes of the magnetic powder particles.

4. The multilayer electronic component of claim 1, wherein the side coil patterns are disposed to be exposed to external surfaces of the body.

5. The multilayer electronic component of claim 1, wherein the magnetic powder particles each have a flake shape, a plate shape, or a long strip shape.

6. The multilayer electronic component of claim 1, wherein each side coil pattern of the coil includes a plurality of central coil patterns disposed to be spaced apart from each other and extend in a direction perpendicular to the major axes of the magnetic powder particles, and the central coil patterns each have a strip shape.

7. The multilayer electronic component of claim 1, wherein the uppermost and lowermost coil patterns of the coil each include a plurality of central coil patterns connecting two end portions opposing each other in a second direction of the body, each central coil pattern has a strip shape, the strip shape of each central coil pattern is disposed to be parallel to or inclined with respect to the second direction of the body.

8. The multilayer electronic component of claim 1, wherein a direction of a magnetic field associated with current flow through the coil is substantially parallel the major axes of the magnetic powder particles.

9. A multilayer chip antenna comprising the multilayer electronic component of claim 1, wherein the multilayer electronic component is disposed as a main antenna in an electronic device.

10. The multilayer chip antenna of claim 9, further comprising a sub antenna in the electronic device, wherein the sub antenna is electrically coupled in series with the multilayer electronic component that is disposed as a the main antenna of the electronic device.

11. A multilayer electronic component of claim 1, comprising:

a body including a plurality of sheets each containing magnetic powder particles; and a coil including an uppermost coil pattern disposed on a top surface of an uppermost sheet among the plurality of sheets, a lowermost coil pattern disposed on a bottom surface of a lowermost sheet among the plurality of sheets, and side coil patterns disposed on edges of central sheets disposed between the uppermost sheet and the lowermost sheet in a central portion of the body, wherein the magnetic powder particles have shape anisotropy, and major axes of the magnetic powder particles are aligned with each other within the body, a top surface of each central sheet includes first side coil patterns and second side coil patterns, the first side coil patterns on each central sheet include a plurality of polygons extended from one of two end portions of the central sheet opposing each other in a third direction of the body to an inner side thereof and disposed to be spaced apart from each other by a predetermined interval in a second direction of the body, and the second side coil patterns on each central sheet include a plurality of polygons extended from the other end portion of the two end portions of the central sheet to an inner side thereof and disposed to be spaced apart from each other by the predetermined interval in the second direction of the body.

12. The multilayer electronic component of claim 11, wherein one end portion of one central coil pattern of the uppermost coil pattern is electrically connected to one of the first side coil patterns on a central sheet disposed immediately below the uppermost sheet through a via, another end portion of the one central coil pattern of the uppermost coil pattern is electrically connected to one of the second side coil patterns on the central sheet disposed immediately below the uppermost sheet through a via, one end portion of one central coil pattern of the lowermost coil pattern is electrically connected to one of the first side coil patterns on a central sheet disposed immediately above the lowermost sheet through a via, and another end portion of the one central coil pattern of the lowermost coil pattern is electrically connected to one of the second side coil patterns on the central sheet disposed immediately above the lowermost sheet through a via.

13. The multilayer electronic component of claim 11, wherein the number of polygons included in the first side coil patterns on one central sheet is equal to the number of polygons included in the second side coil patterns disposed on the same one central sheet.

14. The multilayer electronic component of claim 11, wherein widths of the polygons are measured along the direction of the body, the widths of the polygons within the first and second side coil patterns disposed on a top surface of one central sheet of the plurality of central sheets are the same as, or smaller than, the widths of the polygons within the first and second side coil patterns disposed on a top surface of another central sheet disposed immediately below the one central sheet.

15. An electronic component comprising:

a body comprising a plurality of planar sheets each containing magnetic powder particles having shape anisotropy that are disposed such that a major axis of each magnetic powder particle is parallel to major axes of the other magnetic powder particles and parallel to planes of the planar sheets; and a coil including a plurality of windings disposed on outer surfaces of the body, wherein each winding of the coil includes central coil patterns disposed on a respective outer surface of the body, and an outer surface of each central coil pattern is flush with or disposed outwardly from the respective outer surface of the body, the plurality of windings are spaced apart from each other on the outer surfaces of the body in a direction parallel to the planes of the planar sheets and parallel to the major axes of the magnetic powder particles, the plurality of planar sheets are stacked in the body, and the coil includes first and second lead coil patterns each disposed on one of an upper surface of the uppermost sheet among the plurality of stacked sheets of the body and a lower surface of the lowermost sheet among the plurality of stacked sheets of the body.

16. The electronic component of claim 15, wherein a direction of a magnetic field associated with current flow through the coil is substantially parallel the major axes of the magnetic powder particles.

17. The electronic component of claim 15, wherein the magnetic powder particles having shape anisotropy are disposed such that a major axis of each magnetic powder particle in a respective stacked sheet is parallel to major axes of the other magnetic powder particles in the respective stacked sheet, and wherein the stacked sheets are disposed relative to each other such that major axes of magnetic powder particles in one stacked sheet are parallel to major axes of the magnetic powder particles in the other stacked sheets.

18. A multilayer electronic component comprising:

a body including a plurality of planar sheets each containing magnetic powder particles each having shape anisotropy with a major axis thereof aligned with a plane of the planar sheet and aligned with major axes of other magnetic powder particles within the body, and a coil including an uppermost coil pattern disposed on a top surface of an uppermost sheet among the plurality of sheets, a lowermost coil pattern disposed on a bottom surface of a lowermost sheet among the plurality of sheets, and side coil patterns disposed on edges of central sheets disposed between the uppermost sheet and the lowermost sheet in a central portion of the body, wherein the major axes of the magnetic powder particles are aligned with planes of the planar sheets and with a direction of a magnetic field through a center of the coil resulting from current flow through the coil, at least one of the uppermost coil pattern and the lowermost coil pattern includes a first lead coil pattern and a second lead coil pattern, the first lead coil pattern is connected to a central coil pattern, disposed on the same plane as the first lead coil pattern, and disposed closest to the first lead coil pattern among a plurality of central coil patterns disposed on the same plane as the first lead coil pattern, through a first connection portion, and the second lead coil pattern is connected to another central coil pattern, disposed on the same plane as the second lead coil pattern, and disposed closest to the second lead coil pattern among a plurality of central coil patterns disposed on the same plane as the second lead coil pattern, through a second connection portion.

19. An electronic component comprising:

a body comprising a plurality of planar sheets each containing magnetic powder particles having shape anisotropy that are disposed such that a major axis of each magnetic powder particle is parallel to major axes of the other magnetic powder particles and parallel to planes of the planar sheets, and a coil including a plurality of windings disposed on outer surfaces of the body, wherein each winding of the coil includes central coil patterns disposed on a respective outer surface of the body, and an outer surface of each central coil pattern is flush with or disposed outwardly from the respective outer surface of the body, the plurality of windings are spaced apart from each other on the outer surfaces of the body in a direction parallel to the planes of the planar sheets and parallel to the major axes of the magnetic powder particles, the plurality of planar sheets are stacked in the body, the coil includes side coil patterns disposed on side surfaces of the body between an upper surface of the uppermost sheet among the plurality of stacked sheets of the body and a lower surface of the lowermost sheet among the plurality of stacked sheets of the body, and the side coil patterns include conductive polygons disposed on edge portions of upper surfaces of sheets of the plurality of sheets disposed between the uppermost sheet and the lowermost sheet.

20. The electronic component of claim 19, wherein each conductive polygon extends inwardly from an edge of the upper surface of a corresponding sheet of the plurality of sheets by a length substantially equal to a width of the conductive polygon on the upper surface of the corresponding sheet.

* * * * *